US006888421B2

(12) United States Patent
Jocher

(10) Patent No.: US 6,888,421 B2
(45) Date of Patent: May 3, 2005

(54) POWER ATTENUATOR WITH COUPLING PORT

(75) Inventor: Ronald William Jocher, East Hanover, NJ (US)

(73) Assignee: Lucent Technologies Inc., Murray Hill, NJ (US)

( * ) Notice: Subject to any disclaimer, the term of this patent is extended or adjusted under 35 U.S.C. 154(b) by 100 days.

(21) Appl. No.: 10/442,166

(22) Filed: May 21, 2003

(65) Prior Publication Data

US 2004/0233012 A1 Nov. 25, 2004

(51) Int. Cl.[7] ..... H01P 5/12
(52) U.S. Cl. ..... 333/137; 333/81; 333/17
(58) Field of Search ..... 333/137, 17, 81

(56) References Cited

U.S. PATENT DOCUMENTS 3,868,602 A * 2/1975 Meddaugh ..... 333/17.1
4,065,207 A * 12/1977 Zavitsanos et al. ..... 359/886
5,136,681 A * 8/1992 Takahashi ..... 385/140
6,341,191 B1 * 1/2002 Takahashi ..... 385/140

* cited by examiner

*Primary Examiner*—Michael Tokar
*Assistant Examiner*—Lam T. Mai

(57) ABSTRACT

A power attenuator with at least one coupling port. The coupling port may be provided to monitor input power levels, out put power levels, or other operations of the power attenuator. One or more coupling ports may be located on the power attenuator input part to monitor input power levels and/or on the power attenuator output part to monitor output power levels. The coupling port(s) may be coupled to the main RF path by resistive coupling or reactive coupling. The coupling port(s) allow monitoring of the RF signal passing through the power attenuator to detect for incipient failures.

23 Claims, 2 Drawing Sheets

POWER ATTENUATOR WITH COUPLING PORT

BACKGROUND OF THE INVENTION

Power attenuators are known, however, there is no built-in device to monitor the input to a power attenuator, the internal operation of the power attenuator, or the output of the power attenuator.

SUMMARY OF THE INVENTION

Exemplary embodiments of the present invention provide a power attenuator with at least one coupling port. The coupling port may be provided to monitor input power levels, output power levels, or other performance operations of the power attenuator. One or more coupling ports may be located on the power attenuator input part to monitor input power levels and/or on the power attenuator output part to monitor output power levels. The coupling port(s) are coupled to the main radio frequency ("RF") path by resistive coupling or reactive coupling. The coupling port(s) allow monitoring of the RF signal passing through the power attenuator to detect for incipient failures.

BRIEF DESCRIPTION OF THE DRAWINGS

Exemplary embodiments of the present invention will become more fully understood from the detailed description given below and the accompanying drawings, which are given for purposes of illustration only, and thus do not limit the invention.

It should be emphasized that the drawings of the instant application are not to scale but are merely schematic representations, and thus are not intended to portray the specific dimensions of the invention, which may be determined by skilled artisans through examination of the disclosure herein.

DETAILED DESCRIPTION OF THE EXEMPLARY EMBODIMENTS

Figure 1:
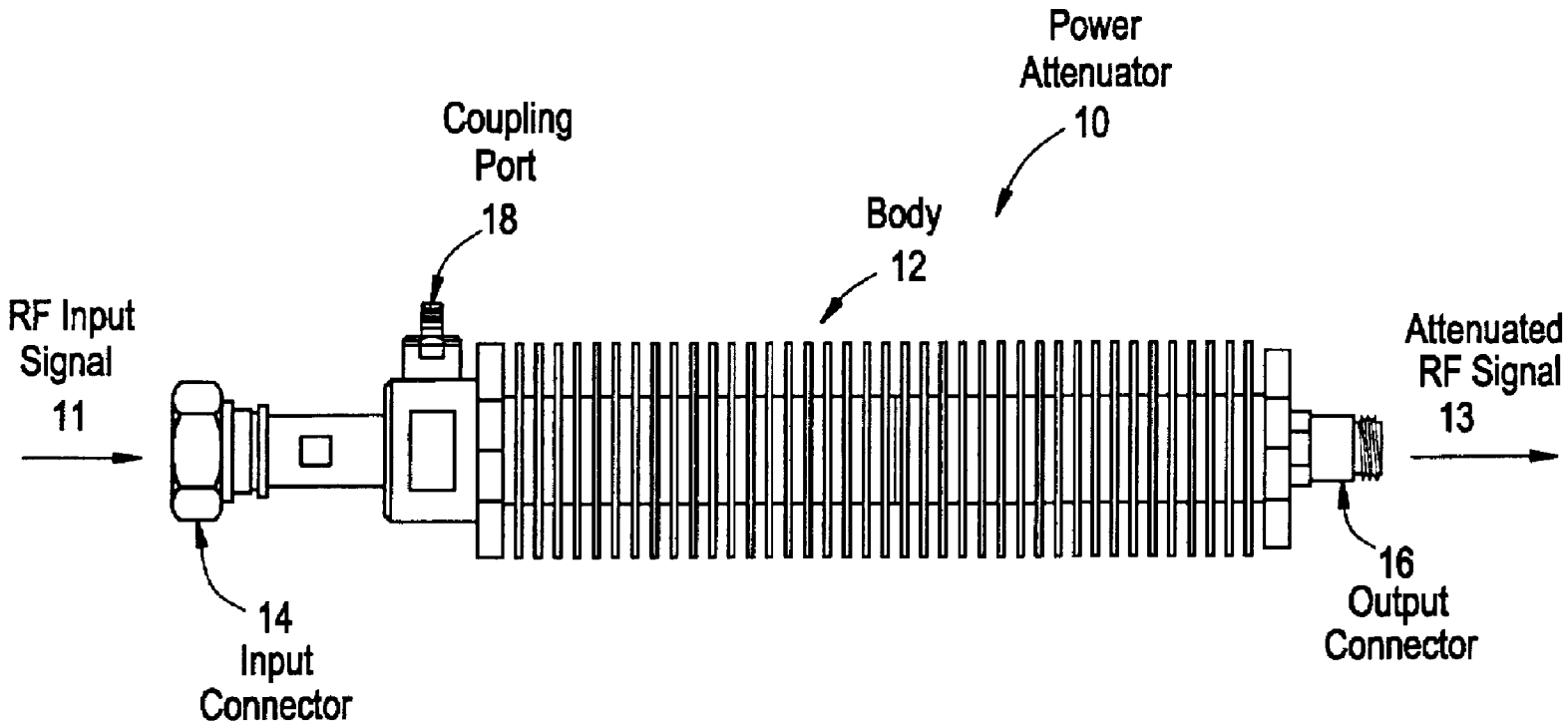
FIG. 1 illustrates a power attenuator with at least one coupling port, in accordance with at least one exemplary embodiment of the present invention.

The present invention, in its exemplary embodiment is directed to a power attenuator 10 with at least one coupling port. FIG. 1 illustrates an exemplary embodiment of the present invention. As shown in FIG. 1, a power attenuator 10 includes a body 12, at least one input connector 14, at least one output connector 16, and at least one coupling port 18. As shown in FIG. 1, the coupling port 18 is provided at the input end of the power attenuator 10, and therefore permits the monitoring of input power levels into the power attenuator 10. It is noted that another coupling port may be provided at the output end of the power attenuator 10 in order to monitor output power levels. Other exemplary power attenuators of the present invention may include input and output coupling ports. In another exemplary embodiment, the power attenuator of the present invention may include more than one input and/or coupling ports.

In operation, one or more RF signals 11 are input through the input connector 14 of the power attenuator 10. The power attenuator 10 attenuates the power of RF signal 11 to produce an attenuated RF signal 13, which may be output by output connector 16. The coupling port 18 allows monitoring (for example constant monitoring) of the RF signal passing through the power attenuator 10.

Figure 2:
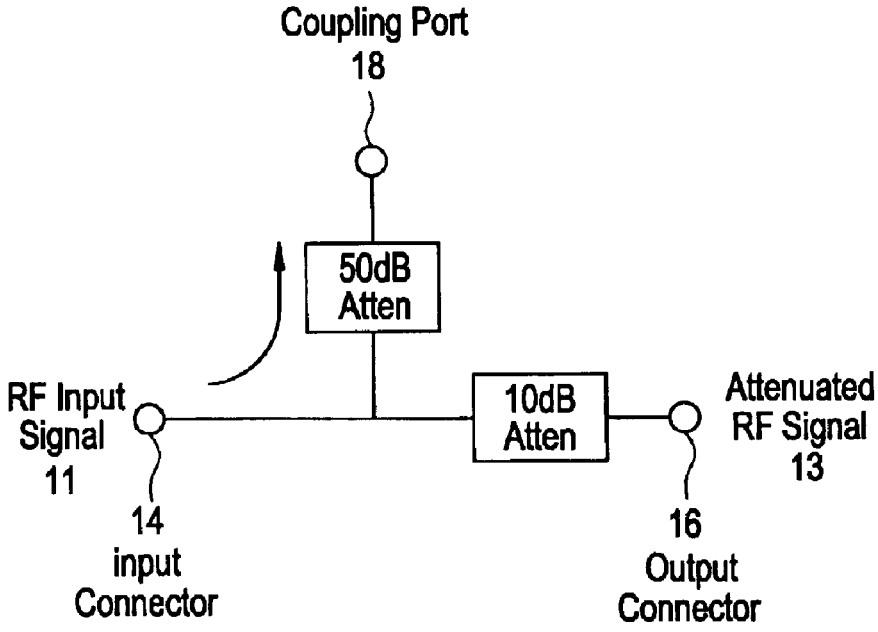
FIG. 2 illustrates an exemplary relationship between the input port, output port, and coupling port of FIG. 1.

FIG. 2 illustrates the relationship between the input connector 14, the coupling port 18, and the output connector 16. As shown in FIG. 2, the power attenuator 10 attenuates the RF signal 11 provided to the output connector 16 by 10 dB and the sampling signal provided to the coupling port 18 by 50 dB. The power attenuator 10 illustrated in FIGS. 1 and 2 may act as a directional coupler with selectable coupling port values.

In exemplary embodiments, the coupling port 18 has an attenuation value of at least −50 dB to ensure low coupling disturbance and provide a high degree of directivity. In another exemplary embodiment, the coupling port 18 has a coupling value from −6 to −50 dB. In exemplary embodiments, the coupling port 18 may be coupled to the main RF path between the input connector 14 and the output connector 16 via resistive coupling or reactive coupling.

In another exemplary embodiment, the input connector 14 connects the power attenuator to an upstream device, such as a mobile system base station, a transmitter, or a broadcasting station.

In another exemplary embodiment, the coupling port 18 samples the one or more signals to monitor for incipient failures in the upstream device.

In an exemplary embodiment, the output connector connects the power attenuator to an RF distribution system or an antenna. The RF distribution system may be used for testing, where low power is desired for specific testing purposes. The antenna may be used in operation and power attenuation is used to reduce the power to acceptable levels for multiple antenna arrays.

In another exemplary embodiment, the power attenuator is a variable value power attenuator, such as a step-value power attenuator. In another exemplary embodiment, the body of the power attenuator 10 is cylindrical in shape. In another exemplary embodiment, the body of the power attenuator 10 has cooling fins to promote airflow. In another exemplary embodiment, the power attenuator 10 may operate as a directional coupler or a power divider. In another exemplary embodiment, the power attenuator 10 may operate in a frequency range of 800 to 2500 MHz, but is not limited to this frequency range. In another exemplary embodiment, the power attenuator 10 has an impedance of 50 ohms, and can be designed for other impedances such as 75 ohm s for a cable TV system. In an exemplary embodiment, the power attenuator 10 has a power rating of 10 to 1000 watts, and more particularly, the power attenuator has a power rating of 100 watts average and 1000 watts peak, however, the attenuator can be designed for any power requirement.

In another exemplary embodiment, the input connector 14 and the output connector 16 may be any type of coaxial connector of either sex. In another exemplary embodiment, the coupling port 18 may be of any coaxial connector type of any other sex. Such types may be standard or special and include, but not be limited to, DIN series connectors, including DIN 7/16, N-type, TNC, SMA, MMX, and other coaxial types.

In another exemplary embodiment, the present invention is directed to a method of detecting incipient failures in an upstream device, such as a mobile system base station, transmitter, or broadcast station. The method includes receiving one or more RF signals 11 using the power attenuator 10, downstream from the upstream device, sampling one or more RF signals using at least one coupling port 18 on the power attenuator 10 and monitoring samples for the incipient failure in the upstream device. In this manner, a problem can be detected and corrective action can begin at an early stage. For example, corrective action can begin while service capacity is low, but before service completely goes down. In an embodiment, a mobile switching center (MSC) can monitor the power output of a mobile base station to detect incipient failures.

Although exemplary embodiments of the present invention are generally described in the context of wireless telephony, the teachings of the present invention may be applied to other systems, wired or wireless, voice, data or a combination thereof, as would be known to one of ordinary skill in the art.

The invention being thus described, it will be obvious that the same may varied in many ways. Such variations are not to be regarded as departure from the spirit and scope of the exemplary embodiments of the present invention, and all such modifications are intended to be included within the scope of the following claims.

I claim:

1. A power attenuator, comprising:

an output connector for enabling the propagation of one or more RF signals along a main RF path through an input connector, a body, and said output connector; and at least one coupling port, coupled to the main RF path, for sampling the one or more RF signals.

2. The power attenuator of claim 1, wherein said at least one coupling port includes at least one coupling input port for monitoring an input power level.

3. The power attenuator of claim 1, wherein said at least one coupling port includes at least one coupling output port for monitoring an output power level.

4. The power attenuator of claim 2, wherein said at least one coupling port further includes at least one coupling output port for monitoring an output power level.

5. The power attenuator of claim 1, wherein said at least one coupling port has an attenuation value of at least −50 dB.

6. The power attenuator of claim 1, wherein said at least one coupling port is coupled to the main RF path by resistive coupling or reactive coupling.

7. The power attenuator of claim 1, wherein said input connector connects said power attenuator to an upstream device.

8. The power attenuator of claim 7, wherein said at least one coupling port samples the one or more RF signals to monitor for incipient failures in the upstream device.

9. The power attenuator of claim 7, wherein the upstream device is a mobile system base station, a transmitter, or a broadcasting station.

10. The power attenuator of claim 9, wherein said at least one coupling port samples the one or more RF signals to monitor for incipient output power failures in the mobile system base station, transmitter, or broadcasting station.

11. The power attenuator of claim 1, wherein said output connector connects said power attenuator to an RF distribution system or an antenna.

12. The power attenuator of claim 1, wherein said power attenuator is a variable value power attenuator.

13. The power attenuator of claim 1, wherein said body is cylindrical in shape.

14. The power attenuator of claim 1, wherein said power attenuator may operate as a directional coupler or a power divider.

15. The power attenuator of claim 1, wherein said power attenuator may operate in a frequency range of 800–2500 mHz.

16. The power attenuator of claim 1, wherein said power attenuator has an impedance in the range of 50–75 ohms.

17. The power attenuator of claim 16, wherein said power attenuator has an impedance of 50 ohms.

18. The power attenuator of claim 1, wherein said power attenuator has a power rating of 10–1000 watts.

19. The power attenuator of claim 18, wherein said power attenuator has a power rating of 100 watts average and 1000 watts peak.

20. The power attenuator of claim 1, wherein said at least one coupling port has a coupling value from −6 to −50 dB.

21. The power attenuator of claim 1, wherein said input and output coaxial connectors may be of any type and either sex.

22. The power attenuator of claim 1, wherein said at least one coupling port may be of any type and either sex coaxial connector.

23. A method of detecting an incipient failure, comprising:

receiving one or more RF signals;

sampling the one or more RF signals using at least one coupling port; and monitoring the samples for the incipient failure.

* * * * *